United States Patent [19]

Henrichon

[11] 4,110,919

[45] Sep. 5, 1978

[54] SKI TRAIL FORMING AND CONDITIONING DRAG

[76] Inventor: Lucien Henrichon, 373 St. Paul St., St. Gabriel, Canada

[21] Appl. No.: 784,889

[22] Filed: Apr. 5, 1977

[30] Foreign Application Priority Data

Apr. 5, 1976 [CA] Canada ..... 249587

[51] Int. Cl.[2] ..... E01H 4/00

[52] U.S. Cl. ..... 37/10; 172/188; 172/784; 172/387; 172/199; 280/19; 37/41

[58] Field of Search ..... 37/41, 10, 13, 50, 51, 37/48; 172/397, 787, 784, 188, 387, 686, 145, 146, 199, 623, 200; 280/19, 142

[56] References Cited

U.S. PATENT DOCUMENTS

| | | | |
|---|---|---|---|
| 2,948,543 | 8/1960 | Collier | 172/393 X |
| 3,576,214 | 4/1971 | Ratcliffe | 172/393 |
| 3,684,031 | 8/1972 | Reynolds | 172/686 |
| 3,739,859 | 6/1973 | White | 172/393 X |
| 3,795,069 | 3/1974 | Cheney | 172/393 X |
| 3,815,688 | 6/1974 | Brown | 37/50 |
| 3,872,931 | 3/1975 | Camp | 172/387 |
| 3,878,900 | 4/1975 | Boisse et al. | 172/188 X |
| 3,915,239 | 10/1975 | Hendrichon | 172/393 X |
| 4,014,116 | 3/1977 | Baechler | 37/10 |

*Primary Examiner*—E. H. Eickholt

[57] ABSTRACT

An apparatus and more specifically a drag adapted to form and condition a ski trail, and in particular two generally parallel ski traces as commonly used for cross-country skiing, such that the ski traces are of uniform parallelism and depth and are free of lumps of ice and snow. This drag includes a rear sled unit and a front unit, a pair of runners forming ski traces secured under the sled unit, a pivotal connection joining the two units and allowing only up-and-down sliding and yaw pivoting of the rear unit relative to the front unit. The rear unit includes a sled platform and a pair of runners of particular construction to cooperatively produce ski traces of uniform parallelism and depth. The front unit includes a frame carried by a runner and adjustable height relative to the latter, scrapers pivoted to the frame of the front unit between a downward operative position and an elevated inoperative position.

2 Claims, 5 Drawing Figures

SKI TRAIL FORMING AND CONDITIONING DRAG

This invention relates to a drag or apparatus of the kind used to condition a snow surface and, more particularly, to an apparatus or a drag of the type adapted to form and maintain a ski trail of the kind used for cross-country skiing.

Cross-country skiing is more advantageously practiced on a ski trail formed with two substantially parallel ski traces of indefinite length. The cross-country ski trails are now currently prepared by levelling or scraping a track of snow without forming the desirable ski traces at the surface. These ski traces are formed by the passage of the skiers themselves and there results a ski trail which is lacking in particular concerning the parallelism of the ski traces and the longitudinal and transverse uniformity thereof. These disadvantageous conditions of the ski traces result from obstacles encountered by the skiers, such as ice and snow lumps, and from the inability of the skiers to produce even ski traces.

It is a general object of the present invention to provide a ski trail forming and conditioning drag of the above type which produces the usual and substantially parallel ski traces used for cross-country skiing, and in particular, which produces such ski traces that are of uniform depth and parallelism and that are free of ice and snow lumps.

It is a general object of the present invention to provide a ski trail forming and conditioning drag of the above type which produces a ski trail with a smooth and slightly compacted main top surface and ski traces having each a bottom surface extending at a limited depth from the main top surface.

It is a more specific object of the present invention to provide a ski trail forming and conditioning drag wherein the ski traces are formed by runners of a sled, wherein the latter is drawn through a pivotal connection which is adapted to induce both longitudinal and transverse levelling effects on the sled, and more particularly, wherein this pivotal connection prevents both pitching and rolling movements of the sled and runners relative to the towing vehicle or body.

The above and other objects and advantages of the present invention will be better understood with reference to the following detailed description of a preferred embodiment thereof which is illustrated, by way of example, in the accompanying drawings, in which.

Figures 1, 2, 3, 4, 5:
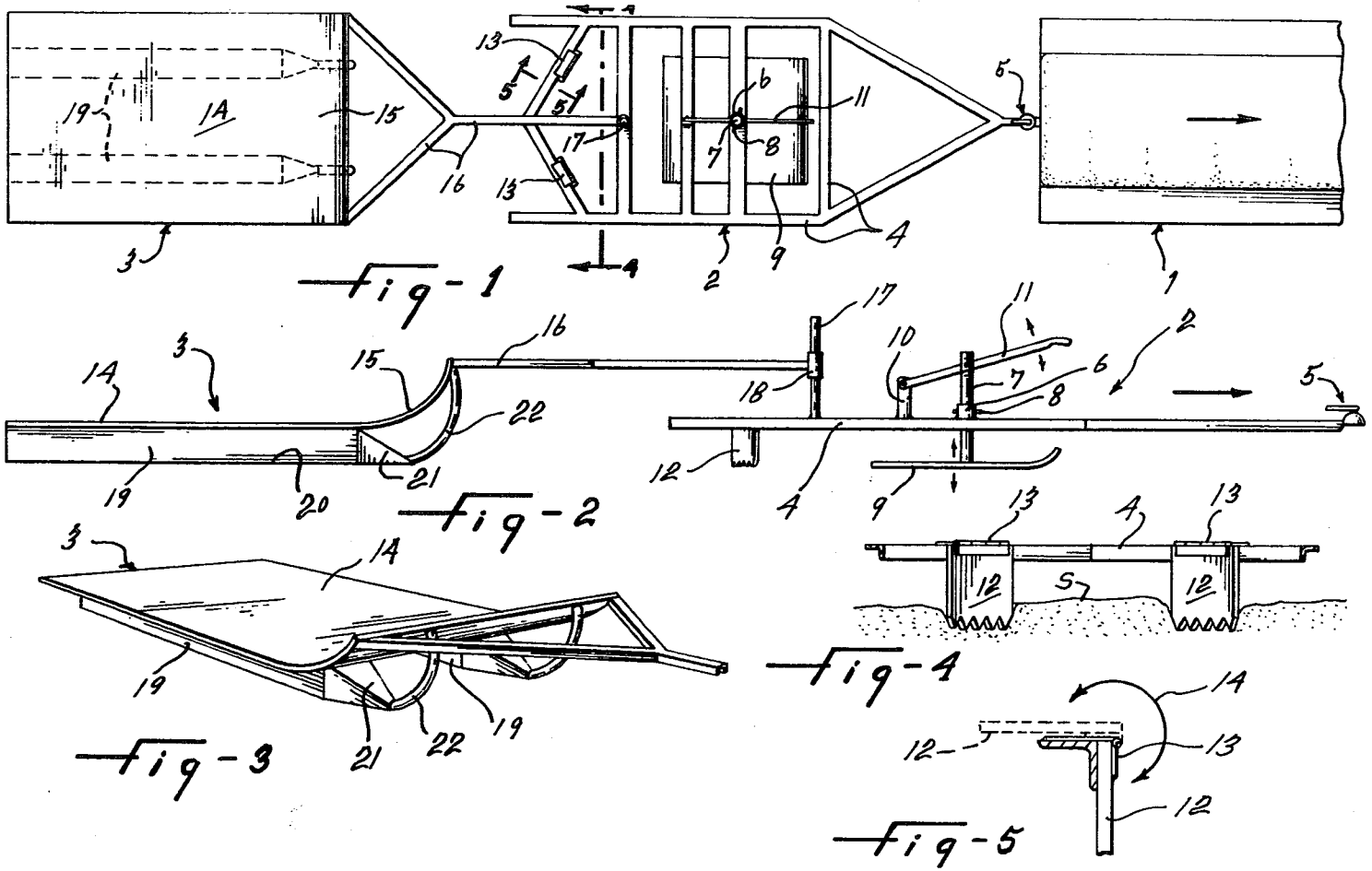
FIG. 1 is an elevation view of a ski trail forming conditioning drag according to the present invention and in operative association with the rear of a snowmobile.
FIG. 2 is a side elevation view of the ski trail forming and conditioning drag of FIG. 1.
FIG. 3 is a perspective view of the rear sled unit forming part of the drag of FIGS. 1 and 2.
FIG. 4 is a cross-sectional view as seen along line 4—4 in FIG. 1 and particularly illustrating a pair of scrapers pivotally connected to the front unit forming part of the present drag.
FIG. 5 is a cross-sectional view as seen along line 5—5 in FIG. 1.

The illustrated ski trail forming and conditioning drag or apparatus is adapted to be towed by a snowmobile 1, shown in part in FIG. 1. The illustrated drag includes a front unit 2 and a rear sled unit 3.

The front unit 2 includes a flat frame 4 formed of metal angles. A female hitch part 5, of any appropriate construction, is provided at the pointed front end of the frame 4 to releasably couple the front unit 2 to the rear of the snowmobile 1. A sleeve bearing 6 is fixedly secured to the frame 4 of the front unit to define a cylindrical aperture axially extending upright through the frame. A post 7, preferably of tubular construction, is slidably engaged in the sleeve bearing 6 for endwise up-and-down displacement in the latter. A pin 8 removably engages diametrically through the sleeve bearing 6 and the post 7 to secure the latter in selected upright position relative to the frame. For that purpose, the post 7 is formed with a series of diametrical apertures laterally spaced from each other along the post. A wide runner 9 is fixedly secured against the bottom end of the post 8 to support the latter and the frame 4 with the latter at a selected height relative to this runner 9 and thus relative to the surface of the snow S.

A bracket 10 provides upright from the frame 4 in alignment with the sleeve bearing 6 and the post 8 longitudinally or the frame 4. An actuation lever 11 is pivoted to the bracket 10 and the post 8 and extends through the latter longitudinally of the front unit, with sufficient play in the post 8 to allow the required pivoting in the latter.

Thus, as can be seen in FIG. 2, and indicated by arrows, the height adjustment mechanism including the post 8 and the lever 11 allows to adjust the height of the frame 4 relative to the wide runner 9 and the snow surface.

A pair of scraper plates, or blades 12, are pivoted each by a hinge 13 to the frame 4, as shown by the arrow 14 in FIG. 5, such that each scraper plate 12 is pivotable about an axis extending transversely of the front unit 2, between a downwardly projecting scraping position and an elevated inoperative position, as shown by the solid and dash lines respectively in FIG. 5. Thus, the scraper plates 12 may be selectively positioned for scraping or stowed away, if not desired or needed. The two scraper plates 12 are arranged obliquely relative to the longitudinal direction of the front unit 2 in a rearward converging relationship. Also, the scrapers 12 are laterally spaced from each other the distance normally separating the ski traces in cross-country skiing. Besides, each scraper 12 is of appropriate width to scrape a track of at least a common ski width.

It will be readily appreciated that the afore-described height adjustment of the frame 4 defines the height of the scrapers 12 and the depth of scraping.

The rear sled unit includes a sled platform made of a generally flat plate 14 having an upwardly curved front edge portion 15. A draw bar 16 is rigidly secured to the front edge portion 15 and projects forwardly therefrom.

A pivotal connection joins the sled unit 3 to the front unit 2 to be towed by the latter. This pivotal connection includes a post 17 rigidly secured upright on the frame 4 of the front unit and a sleeve bearing 18 rigidly secured to the free forward end of the draw bar 16 and axially projecting upright. The sleeve bearing 18 is slidably engaged over the post 17 and freely displaceable relative to the latter. Thus, the rear sled unit 3 is allowed yaw pivoting and upward displacement relative to the front unit 2 but is restrained against both pitch and roll pivoting relative to the front unit. These results levelling effect on the sled unit 3, as will be better explained later.

The sled unit 3 also includes a pair of runners 19 of transverse box-shaped cross-section secured against the flat bottom of the sled platform and extending longitudinally of the sled unit. The box-shaped transverse cross-section is defined by each runner 19 having flat bottom surface 20 and parallel sides extending upright from the flat bottom surface. Each runner 19 has a width substantially equal to the common or usual width of a ski, such that each ski trace will have exactly the desired width. The height between the bottom surface 20 of the runners 19 and the flat bottom of the sled platform is predetermined to form ski traces of a convenient depth and such that the flat bottom of the sled platform will regularly slide over the soft snow to form a main surface of compacted snow with the two ski traces extending at a uniform depth from the main surface of snow. The two runners 19 are laterally spaced apart a predetermined distance corresponding to the normal spacing between ski traces for cross-country skiing.

The front end of each runner 19 is pointed at 21 such that the resulting tip extends coplanar with the flat bottom of the corresponding runner. In other words, as shown in FIG. 2, the flat bottom surface 20 of each runner 19 extends up to and coplanar with the front tip of the runner. A curved rod 22 joins the tip of each runner to the upwardly curved front edge 15 of the sled platform to cause the sled unit 3 to slide over the oncoming obstacles.

The above-mentioned arrangement of the pointed end portion 21 and pointed tip causes the runners 19 to dig a predetermined depth in the snow and V-plowed the snow to form two neat ski traces of slightly compacted sides and a more heavily compacted bottom. Besides, the ski traces so produced have ski traces of desirable spacing and uniform parallelism.

Due to the afore-described pivotal connection, the sled unit 3 and the runners 19 are constrained in roll and pitch to advantageously dig deeper in the more elevated spots and to thus both longitudinally and transversely exert a levelling effect.

I claim:

1. A ski trail forming and conditioning drag comprising a sled unit including a sled platform constituting an elongated plate having a smooth, continuous, flat underface and a front portion forming an upwardly curved leading end, and a pair of runners of common ski width secured against said underface longitudinally extending in the longitudinal direction of said plate, in operatively normal ski-apart lateral spacing relationship relative to each other, and said pair of runners each having a bottom face spaced a predetermined height from said underface of said plate, whereby the depth of ski trace imprints made by the runners does not exceed the predetermined height defined by the vertical distance between the bottom face of the runners and said underface of said plate, each runner having a pointed front end forming a tip and the bottom face of the corresponding runner extends flat and co-planar with the corresponding tip, said drag further comprising a front unit, a pivotal connection joining the sled unit to the front unit, said pivotal connection including a draw bar rigidly secured to the sled platform of the sled unit and projecting from the curved leading end of the sled platform and longitudinally of the latter, a sleeve bearing secured axially upright to the front end of the draw bar, an upright rod rigidly secured to the said front unit, said sleeve bearing being slidably and pivotally engaged over said rod for pivoting and upright sliding displacements of the sled unit relative to the front unit, and said front unit including a frame, a single runner unit, a height adjustment mechanism adjustably connecting said single runner unit to said frame for height adjustment of said frame relative to the single runner, and wherein said height adjustment mechanism includes a post extending upright through said frame and slidable endwise relative to the latter, said single runner unit is fixedly secured to the lower end of said post, a lever is pivoted to said post above said frame and is pivoted to the latter about a pair of transverse parallel axes respectively, and a locking device releasably connects said post to said frame for up-and-down adjustment and locking of said post and height adjustment of said frame relative to the single runner unit, whereby said single runner unit remains at the same angle relative to said frame in any height adjustment position.

2. A ski trail forming and conditioning drag as defined in claim 1, wherein said front unit includes a pair of scraper blades pivoted to said frame between an elevated inoperative position and an operative downwardly projecting position, said blades extend obliquely to said frame and in rearward convergence relationship relative to each other, and said blades are laterally spaced apart from each other with said operatively normal ski-apart lateral spacing relationship and are each of an effective transverse width at least equal to the common ski width.

* * * * *